United States Patent [19]

Olson

[11] Patent Number: 4,794,828

[45] Date of Patent: Jan. 3, 1989

[54] QUICK RELEASE MECHANISM FOR RATCHET WRENCH

[75] Inventor: Gene E. Olson, Kenosha, Wis.

[73] Assignee: Snap-on Tools Corporation, Kenosha, Wis.

[21] Appl. No.: 563,194

[22] Filed: Dec. 19, 1983

[51] Int. Cl.[4] ..... B25B 13/00

[52] U.S. Cl. ..... 81/177.85; 403/325

[58] Field of Search ..... 81/60, 62, 177 G; 403/325, 328

[56] References Cited

U.S. PATENT DOCUMENTS

| | | |
|---|---|---|
| 1,533,619 | 4/1925 | Thompson . |
| 2,474,360 | 6/1949 | Jimerson . |
| 2,675,257 | 4/1954 | Specht . |
| 2,721,090 | 10/1955 | Kaman . |
| 3,118,696 | 1/1964 | Resare . |
| 3,208,318 | 9/1965 | Roberts . |
| 3,438,291 | 4/1969 | Bergquist . |
| 3,638,519 | 2/1972 | Rebold . |
| 3,713,356 | 1/1973 | Knudsen . |
| 3,762,245 | 10/1973 | Smyers et al. . |
| 3,777,596 | 12/1973 | Smyers, Jr. et al. . |
| 3,924,493 | 12/1975 | Penner . |
| 4,187,747 | 2/1980 | Pawlow . |
| 4,292,863 | 10/1981 | Hickman . |
| 4,399,722 | 8/1973 | Sardo, Jr. . |

*Primary Examiner*—James G. Smith

*Attorney, Agent, or Firm*—Emrich & Dithmar

[57] ABSTRACT

The mechanism, used in a ratchet wrench, includes a body carrying an integral stud. A bore extends axially into both and an actuator rod is reciprocally mounted therein. A transverse bore in the stud slidably holds a pin which is linked to the rod. A socket is applied to the mechanism by pushing the socket against a camming surface on the pin to enable the socket to be snapped onto the pin without operating the actuator. The socket is removed by depressing the actuator.

5 Claims, 2 Drawing Sheets

FIG. 6
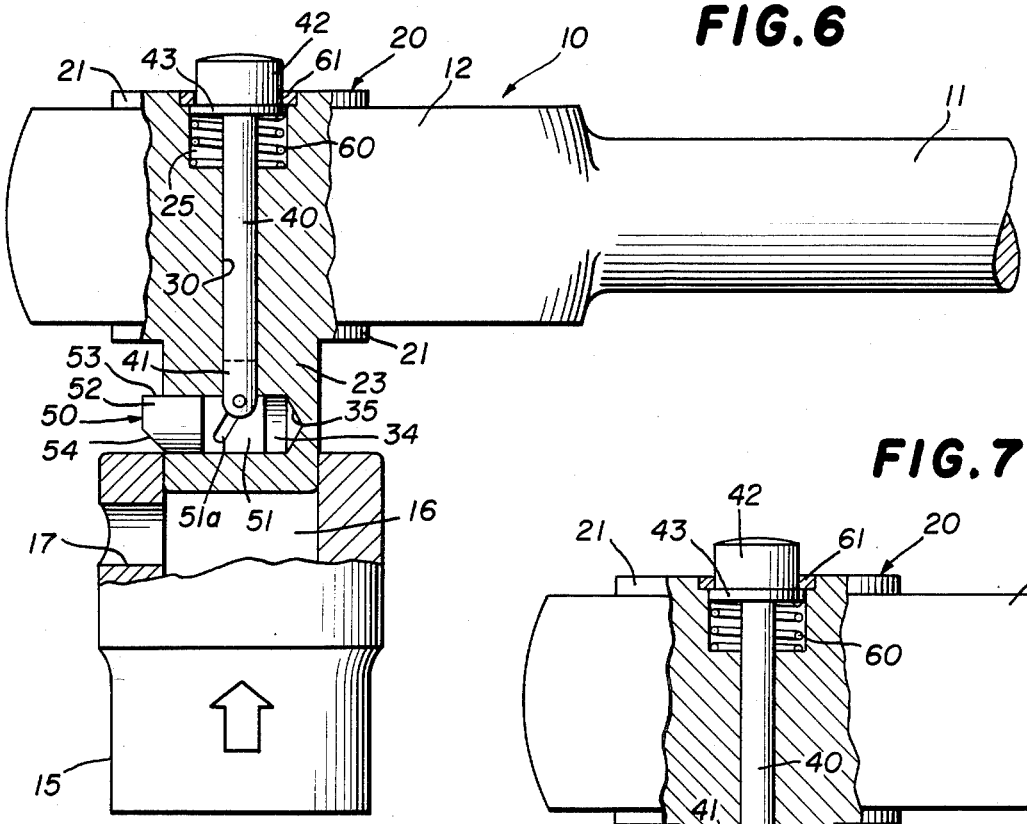
FIG. 7
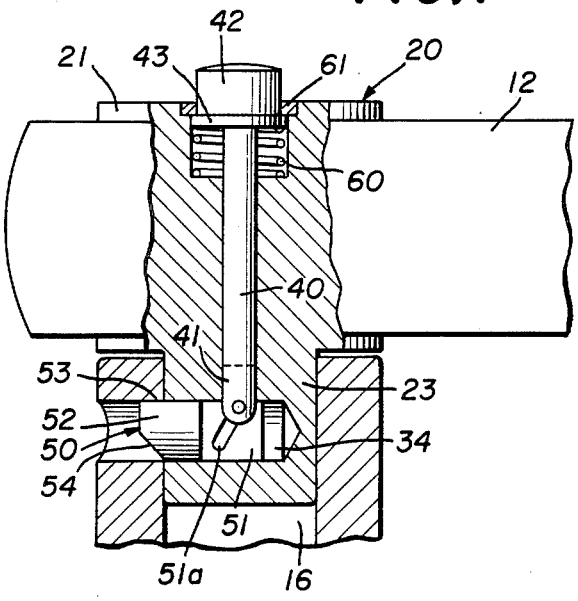
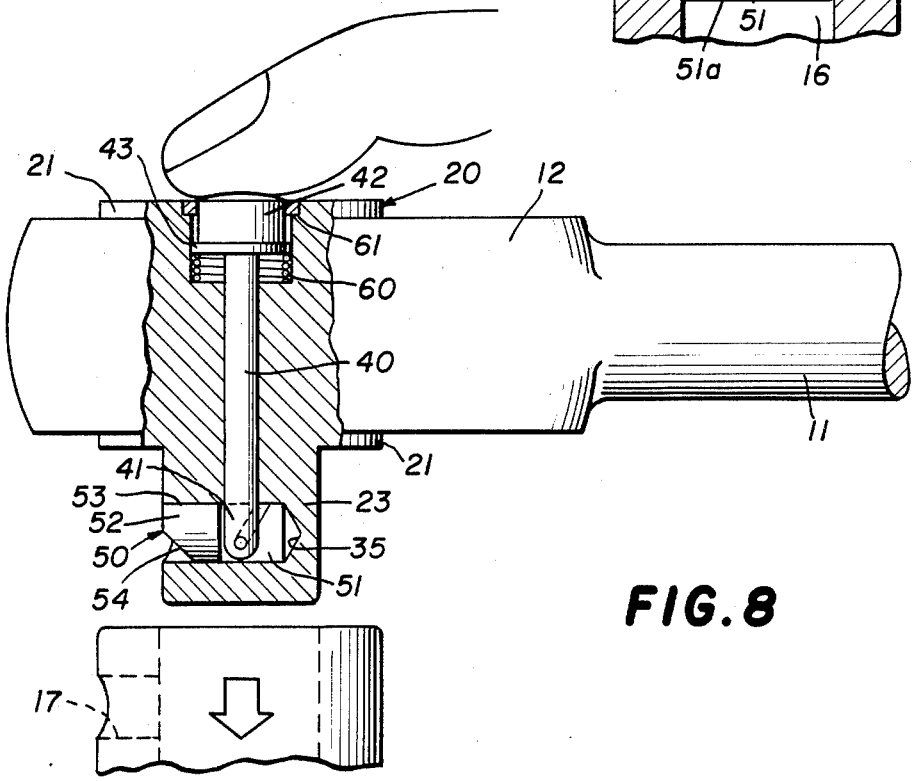
FIG. 8

QUICK RELEASE MECHANISM FOR RATCHET WRENCH

BACKGROUND OF THE INVENTION

A ratchet wrench typically includes a handle and a head which is adapted to releasably engage one of a plurality of sockets of different sizes. A most important feature of a ratchet wrench is its capability of removing a socket quickly and easily.

Generally, prior mechanisms in the marketplace included a ball-and-spring structure. The socket has a side hole into which the ball snaps as the socket is applied to the mechanism. The socket is removed by simply pulling it off. Alternately, such mechanism has a push-button actuator, which is depressed to remove the socket, thus the name "quick-release" mechanism. Whether or not an actuator is provided, the socket can be removed by forcibly pulling it off. This is disadvantageous because a socket has a tendency to fall off inadvertently during use. The socket could be lost or it could fall into a place where it could cause damage to equipment and/or injury to persons. Particularly when these ratchet wrenches are used in industry, inadvertent dislodgement is highly undesirable.

To preclude the socket from inadvertently falling off during use, certain mechanisms in the marketplace do not permit the socket to be simply pulled off. They have positive locking structure which precludes forcibly pulling the socket off of the ratchet wrench Instead, a punch or the like must be inserted into the mechanism to release the socket.

Other prior art mechanisms have a built-in actuator which is operated to remove the socket. But, such prior-art actuators require a more complex action than is desired. Or, they must be operated not only to release the socket, but also to apply the socket.

SUMMARY OF THE INVENTION

It is therefore an important object of the present invention to provide an improved quick release mechanism used in a ratchet wrench.

Another object is to provide a quick release mechanism for a ratchet wrench to which a socket can be snapped into place without operating the actuator.

Another object is to provide a quick release mechanism for a ratchet wrench from which the socket can be removed only by operating the actuator.

Another object is to provide a quick release mechanism for a ratchet wrench having an actuator of the push button variety which need only be depressed to enable removal of the socket.

In summary, there is provided mechanism for locking and releasing an elongated socket having a laterally extending side hole, comprising a generally cylindrical body, a non-annular stud extending from the body and being coaxial therewith, the body and the shaft having an axially extending first bore therein, an elongated actuator slidable in the first bore, one end of the actuator being oriented so as to be movable by a person's finger, the stud having a second bore extending therein substantially normal to the first bore and communicating therewith, a pin slidably located in the second bore and movable between locking and release positions, the pin being biased toward its locking position, the actuator and the pin being linked so as to cause the pin to move to its release position when the one end is depressed and to its locking position when the one end is released, the pin having a portion transversely protruding from the stud in the locking position, the protruding portion having locking and camming surfaces, a socket being applied to the mechanism by pushing the socket against the camming surface to move the pin to its release position and then pushing the socket until the pin snaps to its locking position and into the socket side hole, the socket being removed from the mechanism by depressing the one end to place the pin in its release position, thereby withdrawing the pin from the socket side hole to enable the socket to slip off of the stud.

The invention consists of certain novel features and a combination of parts hereinafter fully described, illustrated in the accompanying drawings, and particularly pointed out in the appended claims, it being understood that various changes in the details may be made without departing from the spirit, or sacrificing any of the advantages of the present invention.

BRIEF DESCRIPTION OF THE DRAWINGS

For the purpose of facilitating an understanding of the invention, there is illustrated in the accompanying drawings a preferred embodiment thereof, from an inspection of which, when considered in connection with the following description, the invention, its construc tion and operation, and many of its advantages should be readily understood and appreciated.

FIG. 6 is a fragmentary view of the ratchet wrench in which the head is cut away to expose the locking and release mechanism, such mechanism being shown partly in section, a socket being also shown partly in section and partly in full;

FIG. 7 is a view, like FIG. 6 after the parts have been assembled; and

FIG. 8 a view like FIG. 6 during disassembly.

DESCRIPTION OF THE PREFERRED EMBODIMENT

Figure 1:
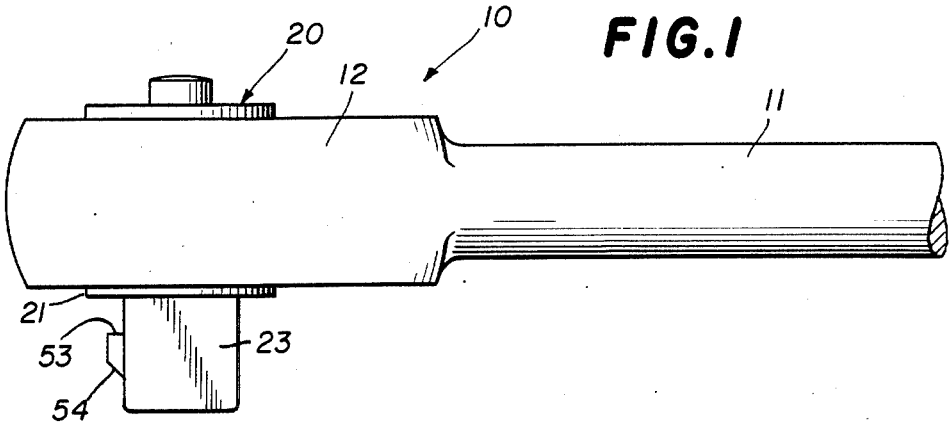
FIG. 1 is a fragmentary view of a ratchet wrench including a release and locking mechanism that incorporates the features of the present invention.
Figure 2:
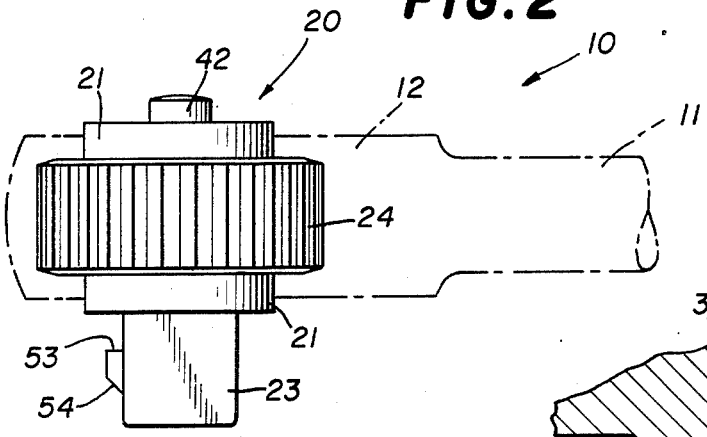
FIG. 2 is a side elevational view of the locking and release mechanism in the ratchet wrench of FIG. 1, the handle and the mechanism holding structure being shown in phantom.
Figure 3:
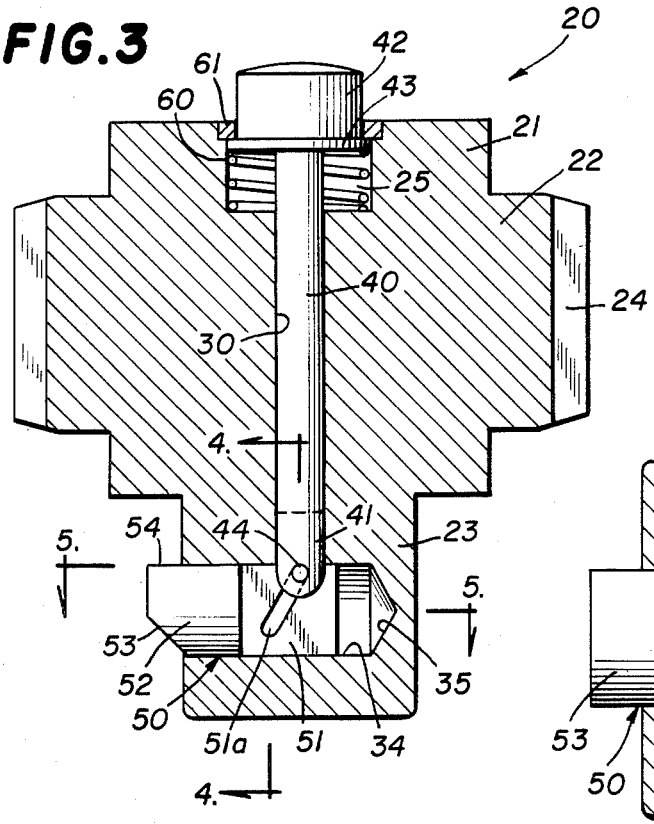
FIG. 3 is a view in vertical section of the locking and release mechanism of FIG. 2, on an enlarged scale.

Turning now to the drawings, there is illustrated in FIGS. 1–3 a ratchet wrench 10 having a handle 11 and a yoke or head 12. The ratchet wrench 10 carries a stud 23 which is square in the embodiment depicted. Referring to FIG. 6, the ratchet wrench 10 is adapted to releasably retain a socket 15 having an axially extending cavity 16 that matches the shape of the stud 23, here square. In the side wall of the socket 15 is an aperture or side hole 17 for use in receiving detent or locking mechanism of the wrench 10, as will be described. Although the side hole 17 is shown to extend all the way through the wall of the socket 15, that is not necessary. Instead, it could be a recess that receives the detent mechanism.

Figure 4:
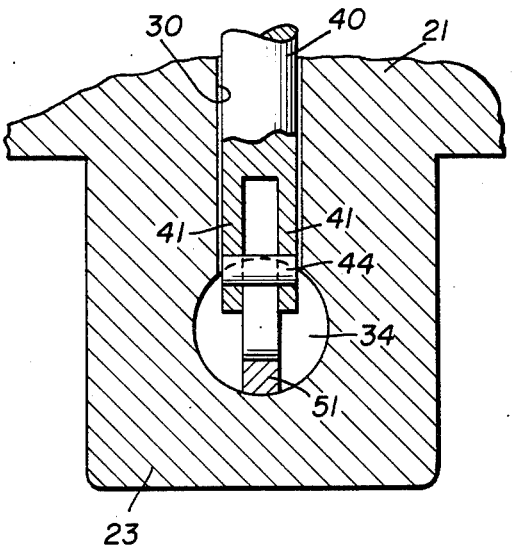
FIG. 4 is a fragmentary view in vertical section taken along the line 4—4 of FIG. 3, on an enlarged scale.
Figure 5:
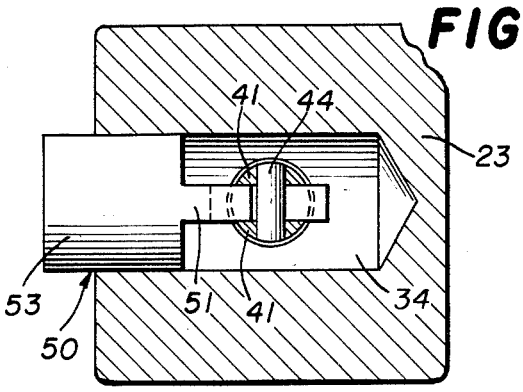
FIG. 5 is a view in horizontal section taken along the line 5—5 of FIG. 3, on an enlarged scale.

Referring back to FIGS. 2 and 3 and also to FIGS. 4 and 5, the ratchet wrench 10 includes a mechanism 20 carried by the head 12. The mechanism 20 includes a generally cylindrical, one-piece body 21 having an enlarged cylindrical portion 22 and the stud 23. The stud 23 is non-annular as previously stated, is elongated and has its longitudinal axis coaxial with the axis of the body 21. A ratchet surface 24 is formed on the exterior of the enlarged portion 22. The ratchet surface 24 engages with mating structure (not shown) in the head 12. The ratchet surface 24 and the mating structure are well known in the prior art, serving to rotate the body 21 in one direction and then to slip or ratchet in the other direction so as to enable unidirectional motion of the body 21 and engaged socket. The wrench 10 usually has a lever (not shown) which enables reversal of the direction of rotation. In one end of the body 21 (upper is viewed in FIG. 5) there is provided a cylindrical stepped recess 25 coaxial with the axis of the body 21. A bore 30 extends through the body 21 and part way into the stud 23. The recess 25 communicates with the bore 30.

The stud 23 has therein a bore 34 extending substantially normal to the axis of the bore 30. The rear end of the bore 34 has a flattened conical shape so as to define a stop 35, for a purpose to be described.

The mechanism 20 further comprises an actuator rod 40, one end of which is bifurcated to define a pair of laterally spaced-apart and longitudinally extending legs 4.. A linking pin 44 is disposed between and connected to the legs 41. The other end of the rod 40 is attached to a push button 42 having an enlarged shoulder 43 of a diameter slightly less than the diameter of the cylindrical recess 25 and slidably located therein.

The mechanism 20 further comprises a locking pin 50 slidably located in the bore 34, the pin including a flat rear portion 51 slidably located between the legs 41. The flat portion 51 has an inclined slot 51*a* therein which slopes away from the axis in the direction of the stud 23. The slot 51*a* slidably receives the linking pin 44. The pin 50 is slidable between a locking position when the pin is forwardmost and a release position when it is rearmost entirely within the bore 34 (as shown in FIG. 8). Rearward movement of the pin 50 is limited by engagement thereof with the stop 35. When the pin 50 is in its locking position, its cylindrical front end portion 52 transversely protrudes forwardly of the stud 23. In the particular embodiment depicted, the diameter of the portion 52 is the same as the non-flattened portion of the pin 50, although its diameter could be different. The portion 52 has a part-cylindrical locking surface 53. The portion 52 also has a camming surface 54 which faces downwardly, that is, away from the body 21.

Located in the larger-diameter portion of the recess 25 and bearing against the shoulder 43 is a compression spring 60 which urges the push button 42 outwardly, thus holding the pin 50 outwardly or in its locking position.

Press fit into the smaller-diameter portion of the stepped recess is a sleeve 61, which retains the rod 40 and the button 42 in the mechanism 20. Alternately, the top surface of the body 21 may be deformed to define limit means for the button 42.

Referring to FIG. 6, a socket 15 is applied to the mechanism 20 by aligning the cavity 16 wit the stud 23 and then pushing the socket 15 toward the mechanism 20. The upper surface of the socket 15 engages the camming surface 54, causing the pin 50 to move rerwardly until it is entirely within the bore 34 while the socket 15 is pushed upwardly. The end of the portion 52 rides against the wall of the cavity 16 until it becomes aligned with the side hole 17. The spring 60 causes the pin 50 to snap to its locking position and, therefore, causes the portion 52 to snappingly enter the side hole 17. The socket 15 cannot be removed by simply pulling it away from the mechanism 20, because the wall of the side hole 17 engages the locking surface 53 to prevent such motion.

To remove the socket 15, the push button 42 is depressed against the bias of the spring 60, causing the linking pin 44 to move downwardly in the slot 51*a*, such motion carrying the pin 50 to its release position. The portion 52 is disengaged from the side hole 17 so that the socket 15 may e slipped off of the stud 23.

High mechanical efficiency is thus produced. A small force applied to the push button 60 causes withdrawal of the pin 50 to its release position.

When one's finger is removed from the button 42, the spring 60 causes the rod 40 to move upwardly and push the locking pin outwardly to its locking position, as depicted in FIG. 6.

Thus, the socket 15 can be slipped onto the stud 23 without operating the push button 42. Once the socket is locked into place, it cannot be removed by simply pulling it. Thus, it cannot inadvertently fall off during use. The push button 42 must be depressed to place the pin 50 in its release position to enable the socket 15 to be removed.

We claim:

1. Mechanism for locking and releasing an elongated socket or other fitting having a laterally extending side hole, comprising a generally cylindrical body, a non-annular stud extending from said body and being coaxial therewith, said body and said stud having an axially extending first bore therein, a rod slidable in said first bore, one end of said rod being oriented so as to be movable by a person's finger and the other end being bifurcated to define a pair of legs, said stud having a second bore therein extending substantially normal to said first bore and communicating therewith, a linking pin extending between said legs, a locking pin slidably located in said second bore and movable between locking and release positions, means biasing said locking pin to its locking position, said locking pin including a flat portion slidably located between said legs, said flat portion having an inclined slot therein slidably receiving said linking pin, said slot being oriented to cause said locking pin to move to its release position when said one end is depressed and to its locking position when said one end is released, said locking pin having a portion transversely protruding from said stud in said locking position, said protuding portion having locking and camming surfaces, a socket being applied to said mechanism by pushing the socket against said camming surface to move said locking pin to its release position and then pushing the socket until said locking pin snaps to its locking position and into the socket side hole with said locking surface disposed for cooperation with the socket to prevent removal thereof, the socket being removed from said mechanism by depressing said one end to place said locking pin in its release position thereby withdrawing said locking pin from the socket side hole to enable the socket to slip off of said stud.

2. The mechanism of claim 1, wherein said rod carries a push button at said one end thereof.

3. The mechanism of claim 2 wherein said body has a further bore therein coaxial with said first bore but of larger diameter to receive said push button when depressed.

4. The mechanism of claim 1, wherein said biasing means is a compression spring which biases said rod outwardly which in turn biases said locking pin to the locking position thereof.

5. The mechanism of claim 1, wherein said protruding portion is substantially cylindrical.

* * * * *